US007510411B2

(12) United States Patent
Wu et al.

(10) Patent No.: US 7,510,411 B2
(45) Date of Patent: Mar. 31, 2009

(54) ELECTRICAL CONNECTOR

(75) Inventors: Tsu-Yang Wu, Tu-cheng (TW); Yun-Fu Tsai, Tu-cheng (TW); Sheng-Ko Chen, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/974,574

(22) Filed: Oct. 15, 2007

(65) Prior Publication Data

US 2008/0090442 A1 Apr. 17, 2008

(30) Foreign Application Priority Data

Oct. 13, 2006 (CN) ..... 200620126391.2

(51) Int. Cl.
*H01R 13/44* (2006.01)

(52) U.S. Cl. ..... 439/135; 439/940; 439/701

(58) Field of Classification Search ..... 439/492, 439/940, 701, 660, 67, 696, 135, 687, 689; 39/687, 689

See application file for complete search history.

(56) References Cited

U.S. PATENT DOCUMENTS 4,194,805 A * 3/1980 Ayer et al. ..... 439/465
4,210,380 A * 7/1980 Brzostek ..... 439/456
4,781,614 A * 11/1988 Ahroni ..... 439/391
5,879,169 A * 3/1999 Wu ..... 439/74
6,168,476 B1 * 1/2001 Yang ..... 439/696
6,287,151 B1 * 9/2001 Matsuzaki et al. ..... 439/630
6,554,624 B1 * 4/2003 Yu ..... 439/135
6,739,906 B2 * 5/2004 Lawrence et al. ..... 439/521
6,890,215 B2 * 5/2005 Lang et al. ..... 439/608
7,090,517 B2 * 8/2006 Ma ..... 439/135
7,140,890 B1 * 11/2006 Ju ..... 439/135
2001/0027065 A1 * 10/2001 Bricaud et al. ..... 439/696

* cited by examiner

*Primary Examiner*—Gary F. Paumen
(74) *Attorney, Agent, or Firm*—Wei Te Chung

(57) ABSTRACT

An electrical connector comprises a dielectric housing which comprises a base portion, a plurality of contact receiving recesses, and engaging holes in diagonal corners thereof; a plurality of conductive contacts retained in said contact receiving recesses; a pick up comprising first engaging pole and second engaging pole corresponding to said engaging holes; each of the first and second engaging poles having a shape of a circular cylinder with a plurality of ribs on a circular surface thereof; said first engaging pole having at least three ribs while said second engaging pole having at least two ribs; the line joining the center of said first engaging pole and the center of said second engaging pole being perpendicular to the line joining the centers of said two ribs of said second engaging pole.

12 Claims, 6 Drawing Sheets

ELECTRICAL CONNECTOR

BACKGROUND OF THE INVENTION

1. Field of the Invention

This invention generally relates to the art of electrical connectors.

2. Description of Related Art

Referring to FIG. 1, an electrical connector 100' which can electrically connect a flexible print circuit board (not shown) to a printed circuit board 40' comprises a dielectric housing 10', four conductive contacts 20' which are retained in the dielectric housing 10' and a pick up 30' which engages with the dielectric housing 10'.

Referring to FIG. 2, the pick up 30' comprises a base 300', an engaging pole 302' and two holding portions 304' on the side of base 300' facing to the dielectric housing 10'. The engaging pole 302' is located between the two holding portions 304'. The engaging pole 302' has a shape like a circular cylinder with a recess 3020' used to contain scraps produced when the engaging pole 302' engages the dielectric housing 10'. The holding portion 304' comprises a resist section 3040' and a holding section 3042'.

The dielectric housing 10' comprises a body member 102' and an engaging portion 104'. The body member 102' comprises four contact receiving recesses 1020' for retaining the conductive contacts 20', the engaging portion 104' comprises an engaging hole 1040' corresponding to the engaging pole 302' of the pick up 30'. There are holding ribs 1022' on the sides of contact receiving recess 1020' corresponding to the holding portions 304' of the pick up 30'.

The conductive contact 20' comprises a retaining portion 201', a first contacting portion 202' for electrically connecting the printed circuit board 40' and a second contacting portion 203' for electrically connecting the flexible printed circuit board. The retaining portion 201' is between the first contacting portion 202' and the second contacting portion 203' and the retaining portion 201' is wider than other portions.

When assembling, the conductive contacts 20' is assembled into the contact receiving recess 1020', then assemble the pick up 30' onto upper portion of the dielectric housing 10', so the engaging poles 302' are inserted into corresponding engaging holes 1040', the outer wall of the engaging poles 302' is interfere with the inner wall of the engaging holes 1040', the resist portion 3040'of the pick up 30' resists the holding ribs 1022'. A pick up device (not shown) can suck the pick up 30' and move the electrical connector 100' to the correct position on the printed circuit board 40'.

In the electrical connector 100', the outer wall of the engaging poles 302' interferes with the inner wall of the engaging holes 1040', in other word, there is a wide engaging face in the wall to wall interfere instance. The scraps produced when inserting will obstruct the engaging poles 302' in moving into the engaging holes for there is no space between the outer wall of the engaging poles 302' and the inner wall of the engaging holes 1040' and the scraps between the walls can not be directly driven into the recess 3020'. In addition, the amount of the interference will easily become very large and cause damage of the dielectric housing 10' if the size of the engaging pole 302' is a little large or if the size of the engaging hole 1040' is a little small. So, it is very difficult to control the size of the engaging pole 302' and the engaging hole 1040'.

SUMMARY OF THE INVENTION

An object of the invention, therefore, is to improve the engagement between the pick up and the dielectric housing.

In the exemplary embodiment of the invention, an electrical connector comprises a dielectric housing, a plurality of conductive contacts and a pick up. The dielectric housing comprises a base portion comprising a plurality of contact receiving recesses and engaging holes in the diagonal corners of said dielectric housing. The conductive contacts are retained in said contact receiving recesses. The pick up comprises first engaging pole and second engaging pole corresponding to said engaging holes. Each engaging pole has a shape of a circular cylinder with a plurality of ribs on a circular surface thereof; Said first engaging pole has at least three ribs while said second engaging pole has at least two ribs. The line joining the center of said first engaging pole and the center of said second engaging pole is perpendicular to the line joining the centers of said two ribs of said second engaging pole.

DETAILED DESCRIPTION OF THE INVENTION

Reference will now be made in detail to the preferred embodiment of the present application.

Figure 1:
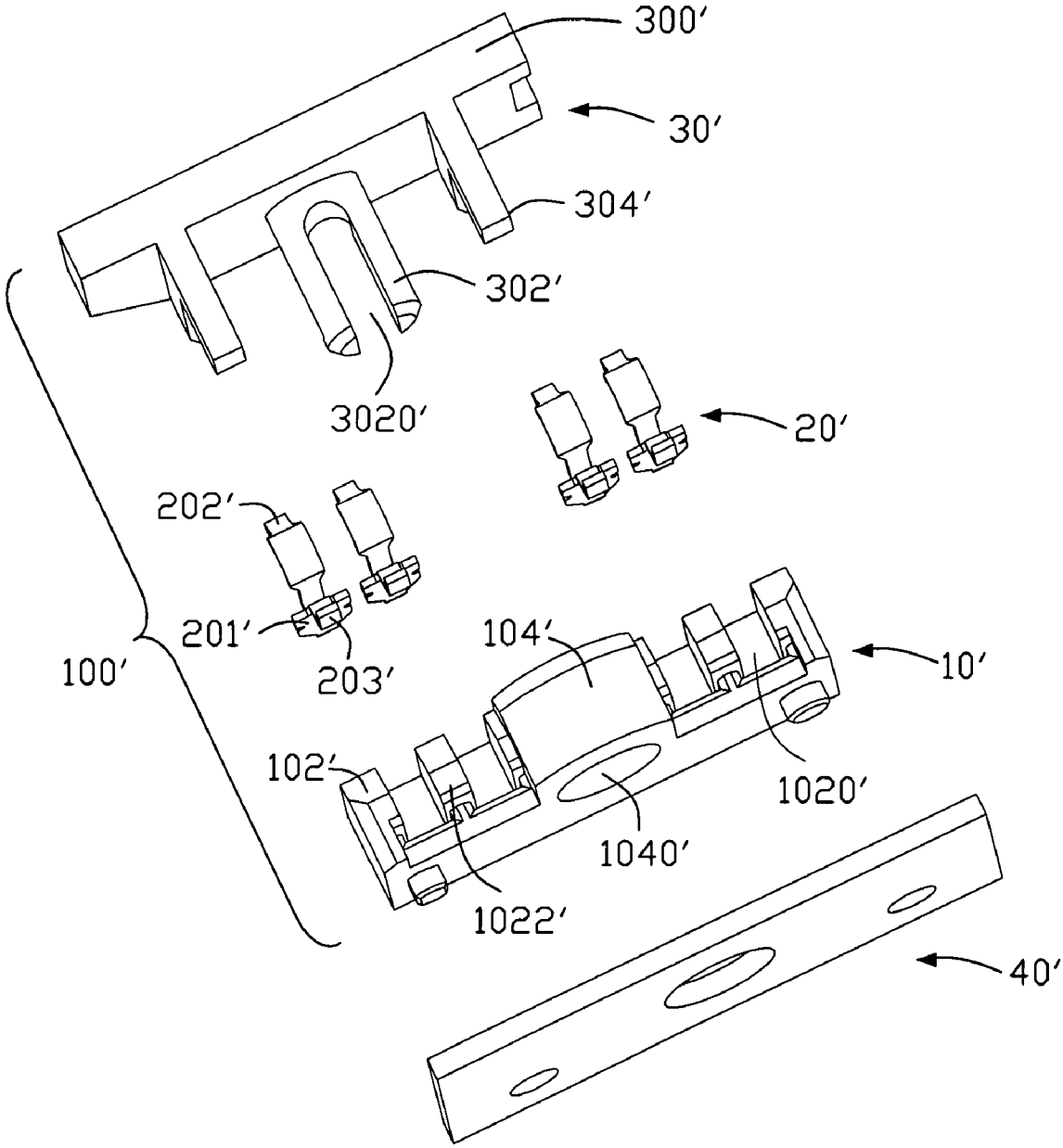
FIG. 1 (RELATED ART)
FIG. 1 is an exploded, perspective view of an electrical connector of related art.
Figure 2:
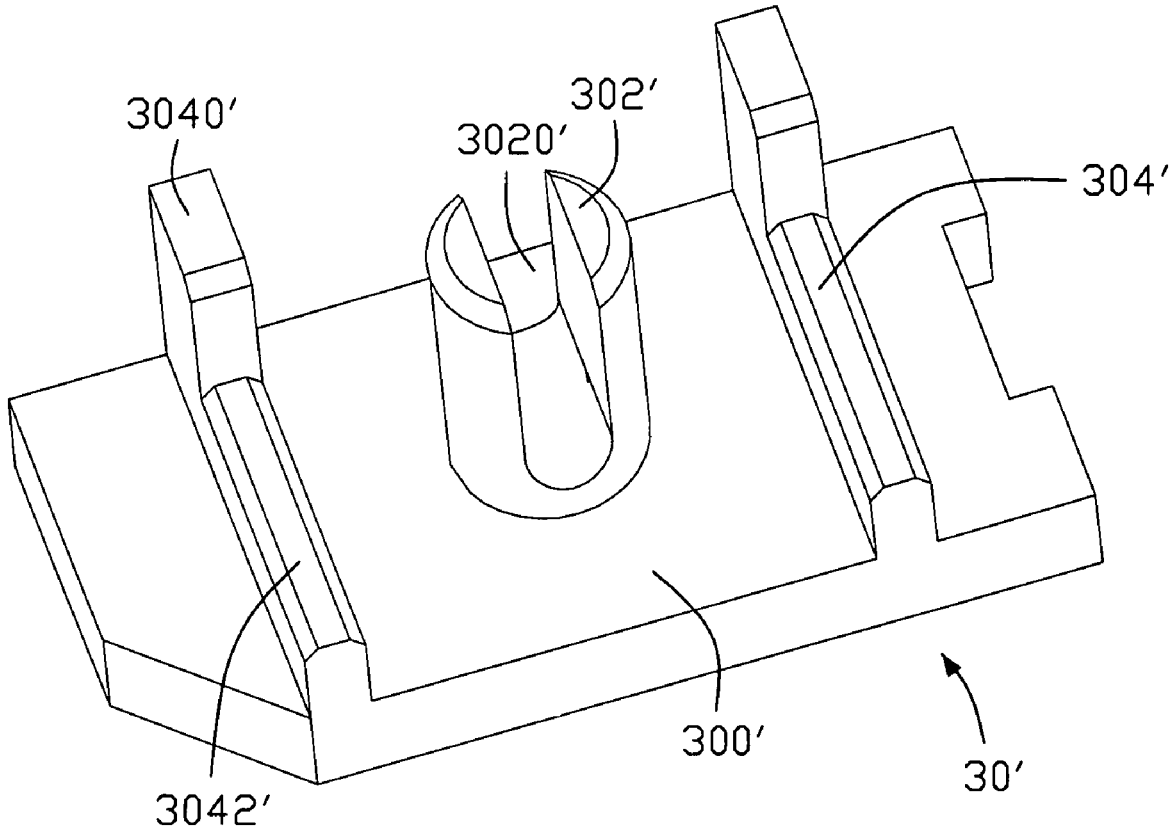
FIG. 2 (RELATED ART)
FIG. 2 is a perspective view of a pick up of the electrical connector of FIG. 1.
Figure 3:
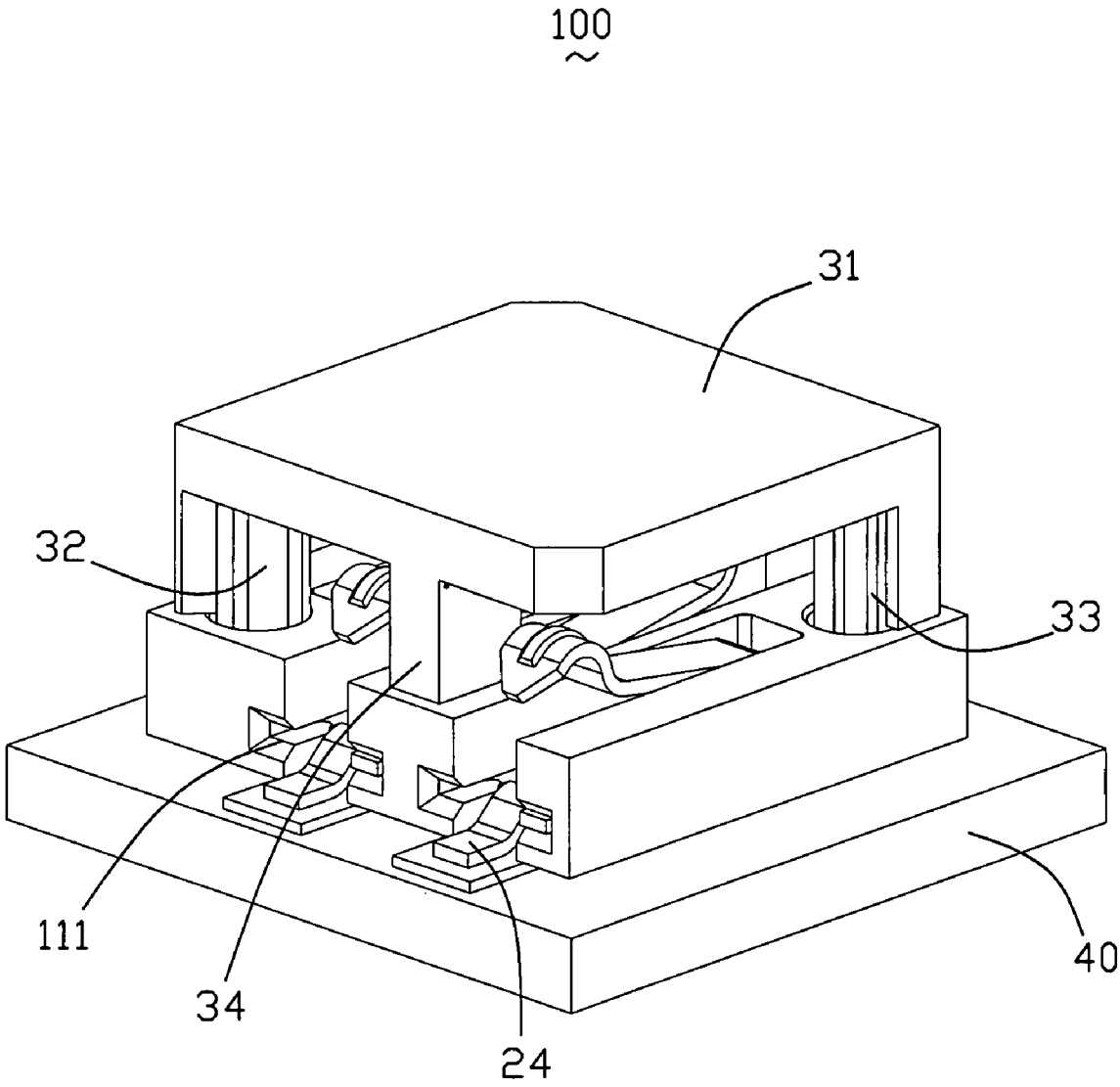
FIG. 3 is an assembled, perspective view of an electrical connector of one embodiment of the present application.
Figure 4:
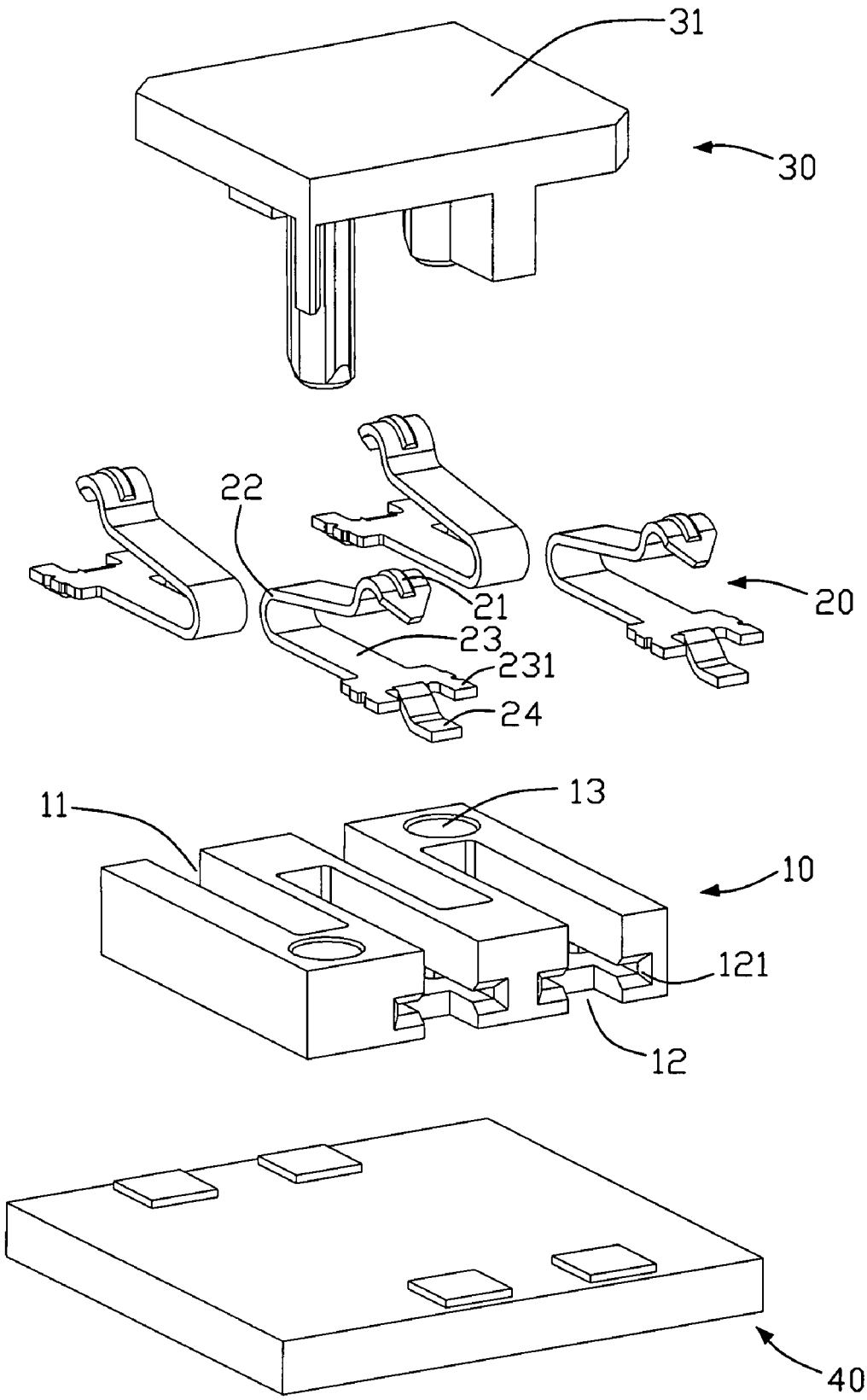
FIG. 4 is an exploded, perspective view of the electrical connector of FIG. 3.
Figure 5:
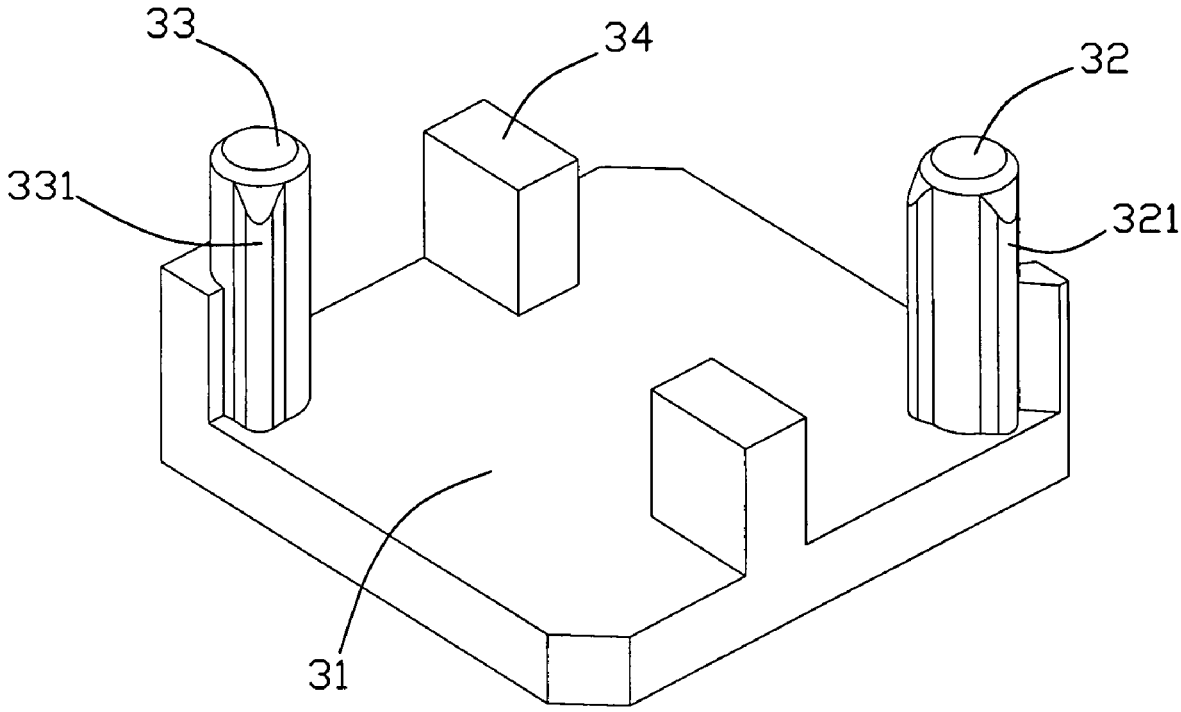
FIG. 5 is a perspective view of a pick up of the electrical connector of FIG. 4.
Figure 6:
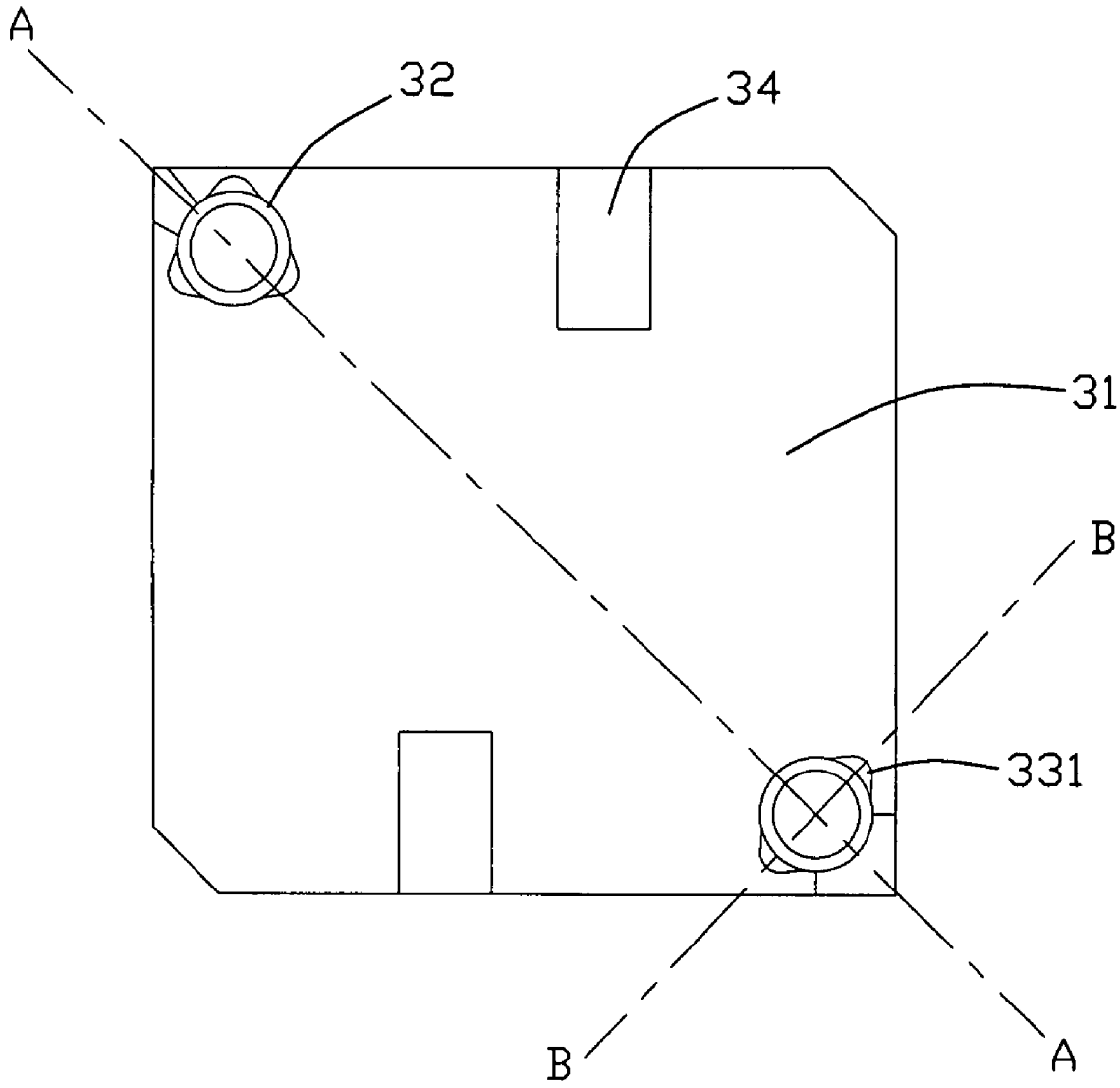
FIG. 6 is a perspective view of a pick up of the electrical connector of FIG. 5 viewed from another aspect.

Referring to FIGS. 3-6, an electrical connector 100 which can electrically connect a flexible print circuit board(not shown) to a printed circuit board 40 comprises a dielectric housing 10, four conductive contacts 20 which retained in the dielectric housing 10 and a pick up 30 which engaging with the dielectric housing 10.

The dielectric housing 10 like a rectangle board which comprises two first receiving recesses 11 and two second receiving recesses 12 alternatively located in the opposite side of the dielectric housing, two engaging holes 13 in the diagonal corners of the dielectric housing, wherein each receiving recess 11, 12 comprises holding cavities 111, 121.

The conductive contact 20 comprises a retaining portion 23, a contacting portion 21 for electrically connecting the flexible printed circuit board , a connecting portion 24 for electrically connecting the printed circuit board 40 and a curved portion 22 connecting the contacting portion 21 and the retaining portion 23. Two holding sections 231 extending out from two opposite sides of said retaining portion 23, a portion between said two holding sections 231 is curved to form said connecting portion 24.

The pick up 30 comprises a rectangle board like body member 31, a first engaging pole 32, a second engaging pole 33 and two protrusion 34. The first engaging pole 32 and the second engaging pole 33 are on the diagonal corners of the body member 31 corresponding to the engaging holes 13 in the dielectric housing 10. Each engaging pole 32, 33 has a shape of a circular cylinder with a plurality of evenly spaced ribs 321, 331 on the circular surface. Wherein the first engaging pole 32 has three ribs 321 while the second engaging pole 33 has two ribs 331, The line A-A joining the center of said first engaging pole and the center of said second engaging pole is perpendicular to the line B-B joining the centers of said two ribs of said second engaging pole.

When assembling, the conductive contacts 20 is assembled into the contact receiving recess 11, 12, then assemble the pick up 30 onto upper portion of the dielectric housing 10. When assembling the pick up 30, the second engaging pole 32 with two ribs 321 can make tiny movement along the diagonal direction if the engaging poles 32, 33 are not just in the specified dimension, so it can prevent slant of the pick up 30 and protect the pick up 30 and the dielectric housing 10 not to be damaged. After the pick up 30 is assembled, the protrusions 34 stacked on the dielectric housing 10 and the engaging poles 32, 33 is inserted into the engaging holes 13, so the ribs 321, 331 of the engaging poles interfere with the inner wall of the engaging holes 13, and the pick up 30 is hold on the dielectric housing 10. Then a pick up device (not shown) can suck the upper surface of the pick up 30 and move the electrical connector 100 to the correct position on the printed circuit board 40.

The length and width of the ribs 321, 331 of the engaging poles 32, 33 can be adjusted to meet the required engaging strength between the pick up 30 and the dielectric housing 10, further, the diameter of the engaging poles 32, 33 can set small, so there leaved a large space between the engaging pole 32, 33 and the engaging hole 13 which can contain the scraps produced. Furthermore, the second engaging pole 32 with two ribs 321 can make tiny movement along the diagonal direction even the engaging poles 32, 33 are not just in the specified dimension, so it can prevent slant of the pick up 30 and protect the pick up 30 and the dielectric housing 10 not to be damaged.

While preferred embodiment of the present application shown and described, it is envisioned that those skilled in the art may devise various modifications of the present invention.

It will be understood that the invention may be embodied in other specific forms without departing from the spirit thereof. The present examples and embodiments, therefore, are to be considered in all respects as illustrative and not restrictive, and the invention is not to be limited to the details given herein.

What is claimed is:

1. An electrical connector comprising:

a dielectric housing comprising a base portion, a plurality of contact receiving recesses, and engaging holes in diagonal corners thereof;

a plurality of conductive contacts retained in said contact receiving recesses;

a pick up cap comprising first engaging pole and second engaging pole corresponding to said engaging holes; each of the first and second engaging poles having a shape of a circular cylinder with a plurality of ribs on a circular surface thereof; said first engaging pole having at least three ribs while said second engaging pole having at least two ribs; the line joining the center of said first engaging pole and the center of said second engaging pole being perpendicular to the line joining the centers of said two ribs of said second engaging pole.

2. The electrical connector of claim 1, wherein said ribs on said engaging poles are evenly spaced.

3. The electrical connector of claim 1, wherein said conductive contacts are retained alternatively in said dielectric housing.

4. The electrical connector of claim 1, wherein said conductive contacts each comprises a contacting portion, a connecting portion and a curve portion which connecting said contacting portion and connecting portion, said contacting portion sticks out from said contact receiving recess.

5. The electrical connector of claim 4, wherein said conductive contacts each further comprises a retaining portion, two holding sections extending out from two side of said retaining portion, a portion between said two holding sections is curved to form said connecting portion.

6. The electrical connector of claim 1, wherein said contact receiving recesses comprise the first receiving recesses and the second receiving recesses, each contact receiving recess comprises a holding cavity for engaging with said corresponding holder of conductive contact.

7. An electrical connector assembly comprising:

an insulative housing essentially defining a square configuration;

two sets of contacts inserted into the housing from two opposite sides of the housing, each of said contacts defining a mating portion exposed above a top face of the housing and a mounting tail located on the corresponding side of the housing;

a pick up cap including a plate defining a similar square configuration, a pair of posts extending from two opposite diagonal corners of the plate to retain to the housing, and at least one supporting protrusion seated upon the top face of the housing.

8. The electrical connector assembly as claimed in claim 7, wherein said supporting protrusion is located around a middle region of the plate and seated upon a middle area of the top face of the housing.

9. The electrical connector assembly as claimed in claim 7, wherein each of said posts defines a plurality of ribs thereon, and the ribs on one of said posts extend in different radial directions from those on the other of said posts.

10. The electrical connector assembly as claimed in claim 7, wherein each of said posts defines a plurality of ribs thereon, and an amount of the ribs on one of said posts is different from that on the other of said posts.

11. The electrical connector assembly as claimed in claim 7, wherein one of said posts defines a pair of ribs thereon, and said pair of ribs spaced from each other in a direction perpendicular to a diagonal direction defined by said pair of posts.

12. The electrical connector assembly as claimed in claim 7, wherein further including another supporting protrusion under a condition that said supporting protrusion and said another supporting protrusion are respectively located on said two sides of the housing and are offset from each other in a transverse direction along which said two sides extend.

* * * * *